US009447979B2

(12) United States Patent
Corleoni et al.

(10) Patent No.: US 9,447,979 B2
(45) Date of Patent: Sep. 20, 2016

(54) SUCTION HOOD

(75) Inventors: Francesco Corleoni, Meldola (IT); Cedric Damien Catalogne, Udine (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 1120 days.

(21) Appl. No.: 13/132,353

(22) PCT Filed: Dec. 10, 2009

(86) PCT No.: PCT/EP2009/008824

§ 371 (c)(1),
(2), (4) Date: Oct. 21, 2011

(87) PCT Pub. No.: WO2010/066422

PCT Pub. Date: Jun. 17, 2010

(65) Prior Publication Data

US 2012/0037144 A1 Feb. 16, 2012

(30) Foreign Application Priority Data

Dec. 10, 2008 (EP) ..... 08021415

(51) Int. Cl.
*F24C 15/20* (2006.01)

(52) U.S. Cl.
CPC ..... *F24C 15/20* (2013.01)

(58) Field of Classification Search
CPC F24C 15/20; F24C 15/2028; F24C 15/2042; F24F 2013/0616; B08B 15/02
USPC ..... 454/49, 56, 58, 65, 66, 67, 253, 305, 454/329, 341, 344, 345; 126/299 F, 299 R, 126/300
See application file for complete search history.

(56) References Cited

U.S. PATENT DOCUMENTS

| | | | | |
|---|---|---|---|---|
| 3,943,836 | A * | 3/1976 | Kuechler | 126/299 D |
| 6,551,185 | B1 * | 4/2003 | Miyake et al. | 454/234 |
| 6,620,038 | B1 * | 9/2003 | Kikuchi et al. | 454/66 |
| 6,632,132 | B1 * | 10/2003 | Kikuchi et al. | 454/66 |
| 6,886,554 | B2 * | 5/2005 | Cheng | 126/299 D |
| 2006/0199520 | A1 * | 9/2006 | Chung et al. | 454/238 |
| 2007/0202791 | A1 * | 8/2007 | Lee et al. | 454/49 |

FOREIGN PATENT DOCUMENTS

| | | |
|---|---|---|
| EP | 0753706 | 1/1997 |
| EP | 1887286 | 2/2008 |
| JP | 2000266385 | 9/2000 |
| JP | 2004332967 | 11/2004 |
| JP | 2005317205 | 11/2005 |
| WO | 8911926 | 12/1989 |

OTHER PUBLICATIONS

International Search Report for PCT/EP2009/008824, dated Jun. 8, 2011, 3 pages.

* cited by examiner

*Primary Examiner* — Gregory Huson
*Assistant Examiner* — Dana Tighe
(74) *Attorney, Agent, or Firm* — Pearne & Gordon LLP

(57) ABSTRACT

The invention relates to a sucking means, preferably vortex generator or tornado suction means, preferably for a suction hood, which pulls the air into a suction hood by generating an at least substantially circular, cyclone, vortex or helix movement, wherein the sucking means comprises a, preferably ring shaped, area with at least substantially tangential channels and/or channels with a tangential component which are separated from each other by separating elements, preferably blades, for generating the at least substantially circular, cyclone, vortex or helix movement, a suction hood and a method for generating an air suction by means of a suction hood.

23 Claims, 11 Drawing Sheets

SUCTION HOOD

The invention relates to a suction hood, which sucks air from a first area to a second area.

Known or traditional suction hoods, which also can be denominated as destructor hoods, range hoods, kitchen hoods, stove to hoods, exhaust hoods, cooker hoods, extraction hoods, cooking canopy or ventilation hoods, are used to remove airborne grease, combustion products, smoke, odours and/or heat and steam, which is generated usually by a cooking process on a cooktop, normally by a combination of filtration and evacuation of the air. They usually comprise three main components: A skirt or capture panel to contain the rising gases (also known as the "effluent plume"), one or more grease filters, and a fan or tangential blower for forced ventilation.

There are two major applications of extractor hoods: vented application, and recirculating application. In a vented application, the output collar of the extractor hood's blower motor is attached to a duct system, which terminates outside of the kitchen. In a recirculating application, a filter containing activated charcoal is used to remove odour and smoke particles from the air, before releasing the cleaned air back into the kitchen environment.

The fans or blowers create, when activated, an area of low pressure which takes effect spherically around the hood.

The airborne grease, combustion products, smoke, odours, heat and steam generated by the cooking of food on the cooktop rise naturally in a vertical motion due to gravity effect, and enter the effective area of the hood to be captured by the low pressure area.

Figure 1A:
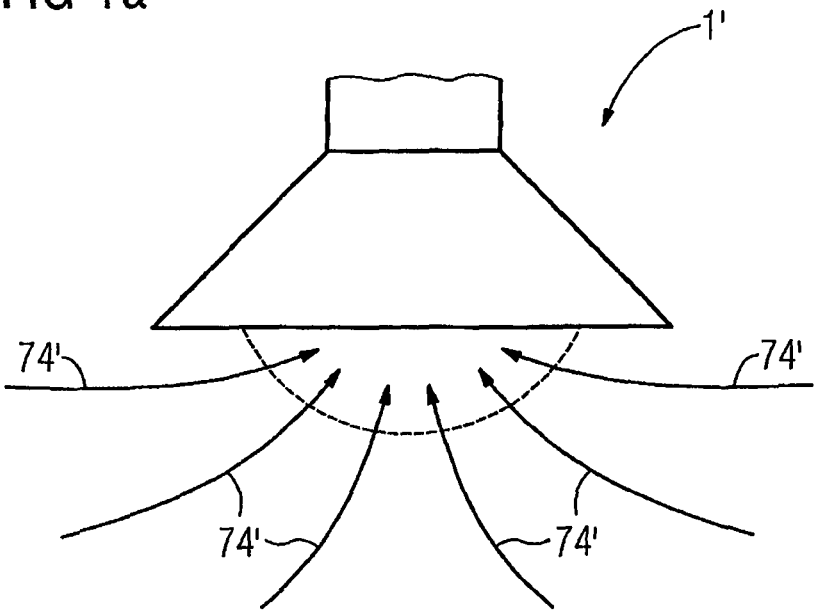

The traditional hoods as described above present at least relatively low efficiency in treating the fumes from the cooktop as they suck-up equally air from the surrounding environment. FIG. 1*a* shows such a hood 1', where the gas is sucked in from all sides along paths shown by arrows 74'.

Figure 1B:
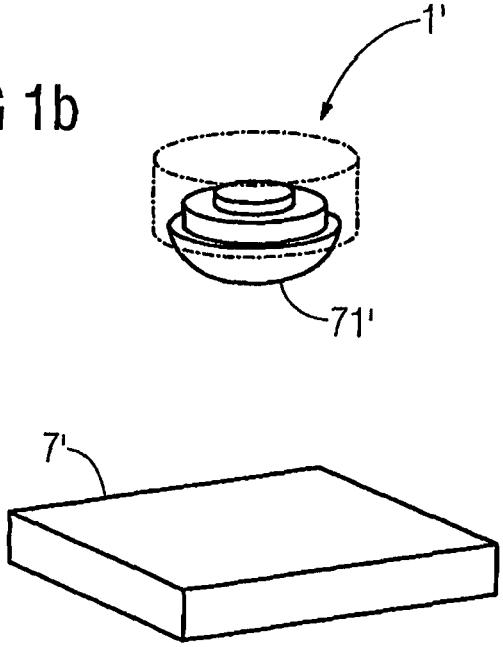

The pressure field 71' of a traditional hood 1' over a cooktop 7' is shown in FIG. 1*b*. The pressure field represents the effective suction volume of the hood.

In WO 89/11926 A1, a ventilating system has been proposed with nozzles and/or blowers mounted around one or more centrally located exhaust channels.

In is an object of invention, to improve the characteristics of the suction means and the hood, especially the suction characteristics, preferably in a cost-effective way.

This object is solved by a suction hood according to claim 1. Advantageous embodiments can be derived especially from the dependent claims.

According to claim 1, the invention relates to a sucking means, preferably vortex generator or tornado suction means, preferably for a suction hood, which pulls the air into a suction hood by generating an at least substantially circular, cyclone, vortex or helix movement, wherein the sucking means comprises a, preferably ring shaped, area with at least substantially tangential channels and/or channels with a tangential component which are separated from each other by separating elements, preferably blades, for generating the at least substantially circular, cyclone, vortex or helix movement.

The separating elements allow in a very effective and cost-efficient way the generation of an at least substantially circular, cyclone, vortex or helix movement. This arrangement, in turn, is able to generate a vortex and/or tornado movement which improves the suction characteristics of the suction means.

Preferably, each channel is, on one side, delimited by the upper cover and on one side delimited by the lower cover of the sucking means and/or each channel is on two sides delimited by the separating elements which are in between them. This embodiment of constructing the channels can reduce the number of parts and/or the amount of material and therefore helps top reduce costs.

In an advantageous embodiment, the sucking means comprises, in at least one channel, a fan for generating the at least substantially circular, cyclone, vortex or helix movement. A fan is usually able to generate a constant air movement and therefore a constant vortex movement.

In a preferred embodiment, the sucking means comprises at least one fan, wherein between the channels and the at least one fan, a distribution chamber is arranged. The distribution chamber distributes the provided air, wherein, at the same time, only a minimized number of fans a necessary.

Preferably, the distribution chamber is surrounding the channels, preferably at least in radial direction, wherein, preferably radially, beyond the distribution chamber, at least one fan for supplying the distribution chamber with air is arranged, wherein the distribution chamber supplies the channels with air for generating the at least substantially circular, cyclone, vortex or helix movement.

In an advantageous embodiment, the sucking means is arranged in a box which can be inserted into and/or taken out of the hood, preferably as one piece and/or the sucking means comprises a filter which preferably can be mounted on the upper cover. A box which can be inserted into and/or taken out of the hood enables an easy assembling into a suction hood, for example.

Another aspect of the invention relates to a suction hood with a sucking means according to the invention.

Preferably, an outer suction area around the suction means surrounds an inner suction area inside the ring shaped area wherein preferably the sucking means sucks the air to the suction hood at least mostly through the inner suction area.

In an advantageous embodiment, the air for operating the sucking means is sucked in laterally, preferably through lateral openings and/or from the outer suction area. This is a very effective way to pull in the air while, at the same time, not affecting the generated vortex movement.

Preferably, a second suction means, preferably an additional fan, is arranged for pushing the air out of the hood wherein the second sucking means sucks the air to the suction hood uniformly through the inner and the outer suction area. This can help to improve the guidance of the air inside the upper part of the suction hood.

In an advantageous embodiment, the sucking means boosts or can boost the second suction means where the boosting is preferably dependent on noise, efficiency and/or fumes, wherein the means used for boosting is preferably a switch and/or a sensor driven device. This helps to boost the power of the sucking means when necessary, especially when a lot of fumes are generated.

In a preferred embodiment, the sucking means is preferably arranged at or near the lower surface and/or a broadened area of the hood and/or the second sucking means is a standard suction means, preferably arranged at or near the lower surface and/or a narrowed area the hood. An arrangement of the sucking means near the lower surface enables can improve the suction, as the vortex is normally arranged directly below the sucking means. An arrangement in a broadened area of the hood makes it possible to provide a lateral suction area around the sucking means.

Preferably, the suction hood is a vented and/or a recirculating suction hood.

Furthermore, the invention relates to a method for generating an air suction by means of a suction hood according to the invention.

Figure 1C:
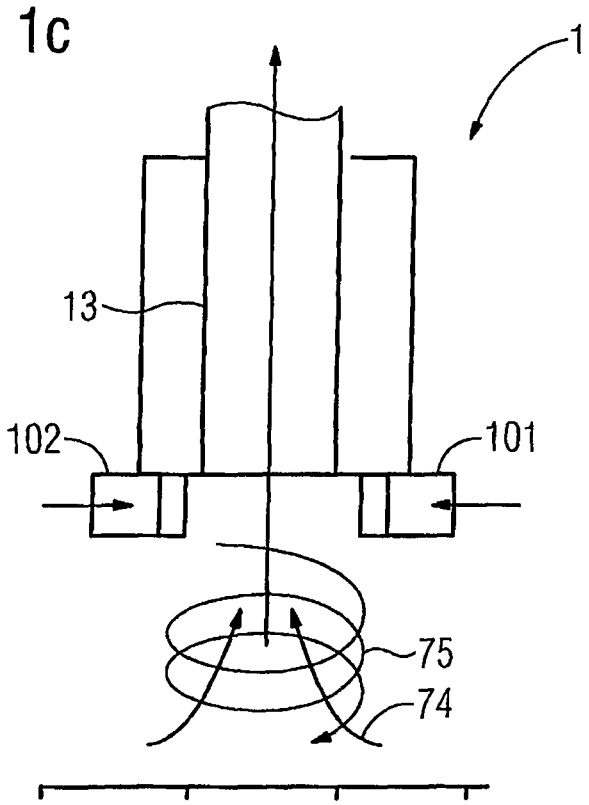
Figure 2:
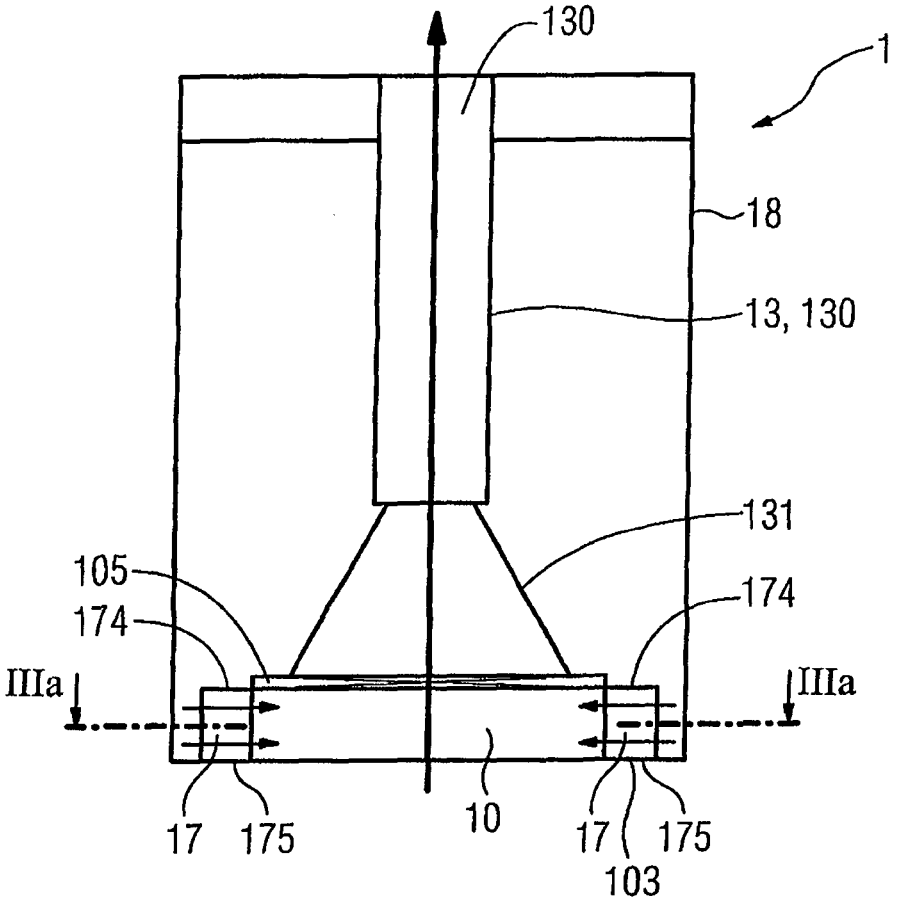
Figure 3A:
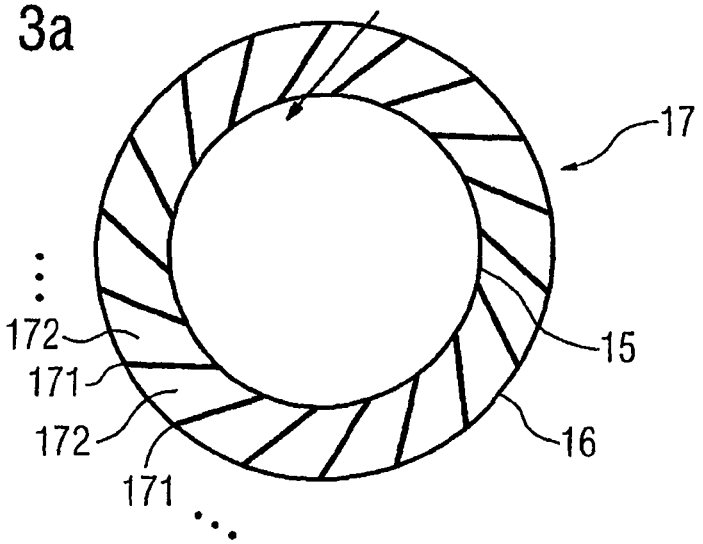
Figure 3B:
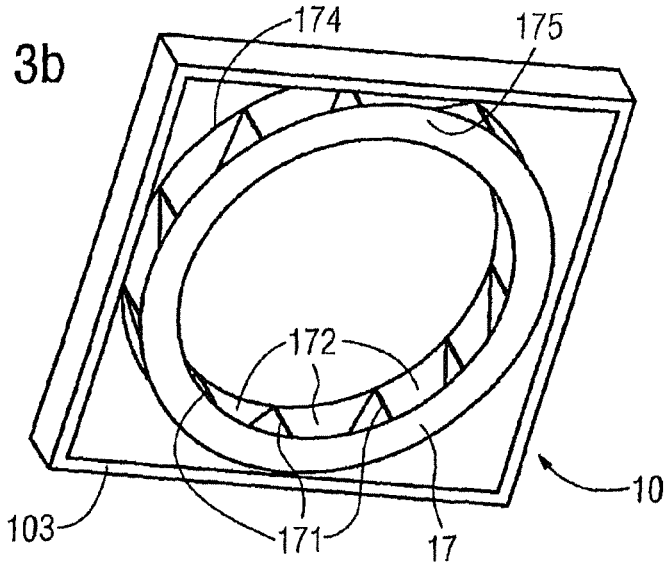
Figure 5A:
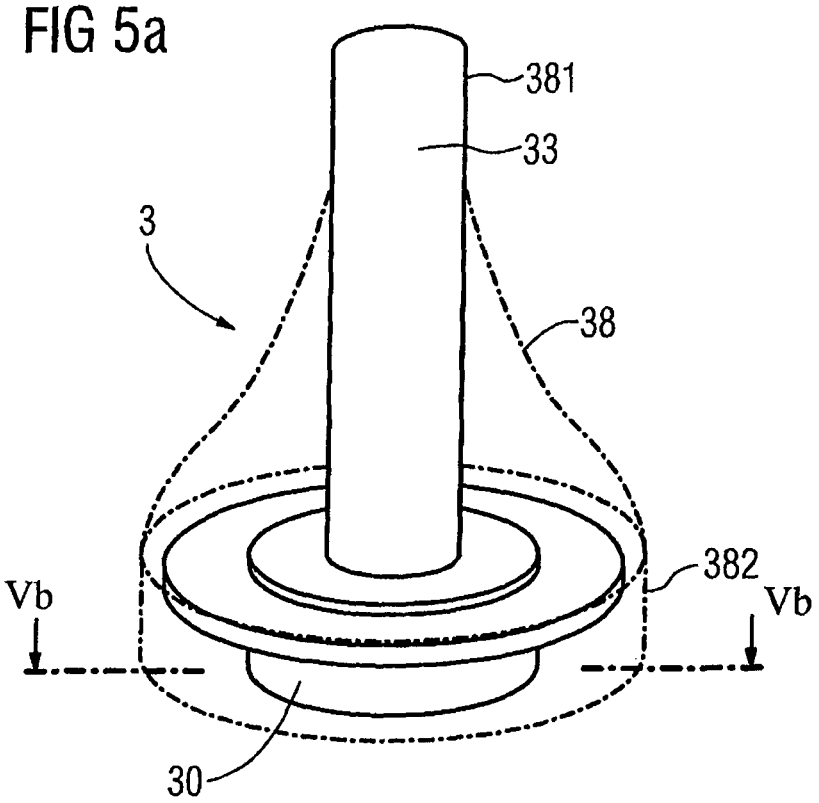
Figure 5B:
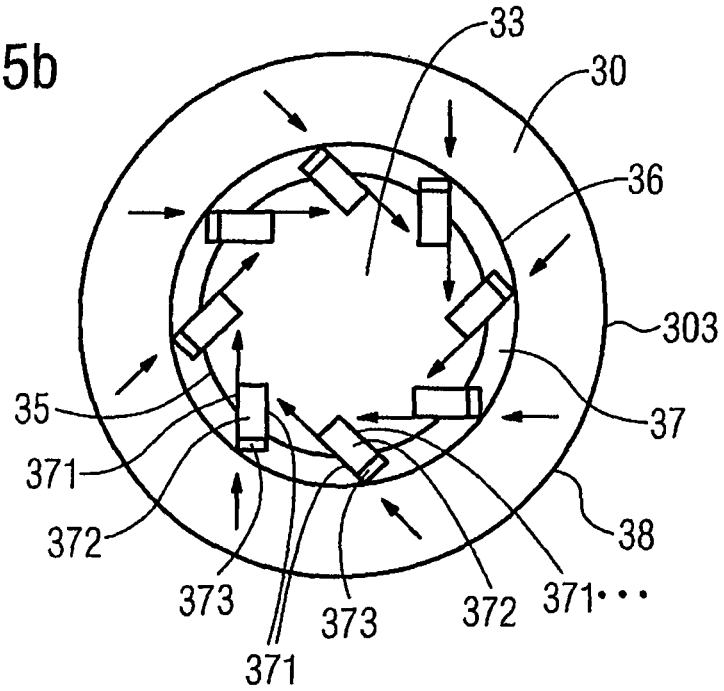
Figure 5C:
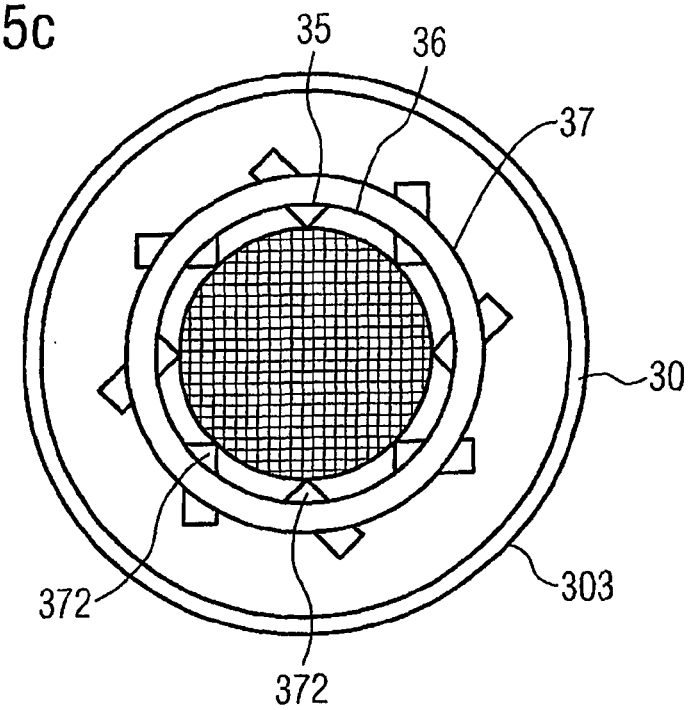
Figure 5D:
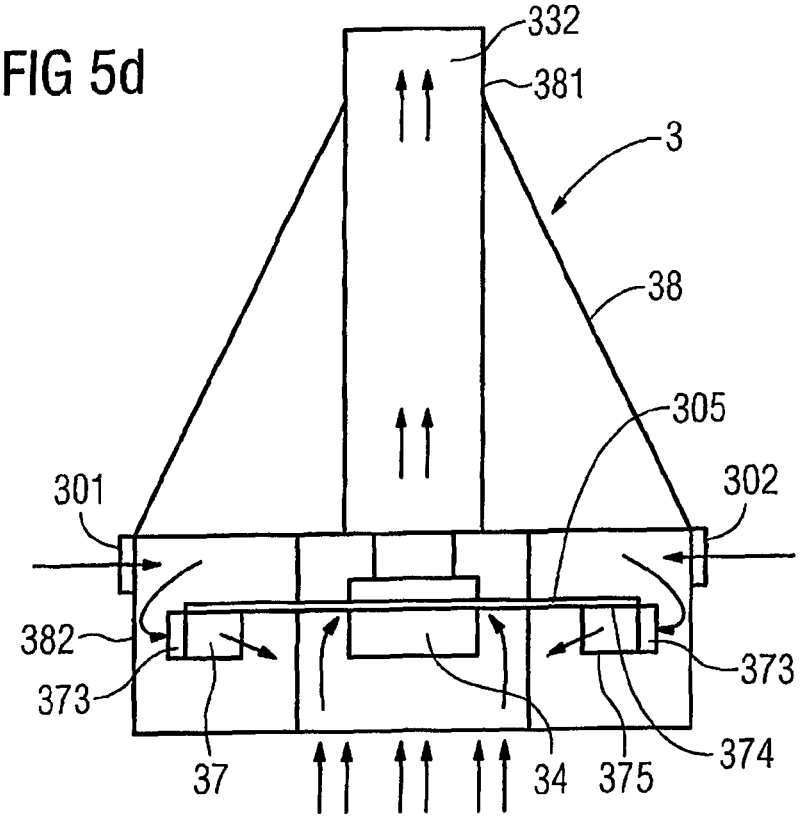
Figure 6A:
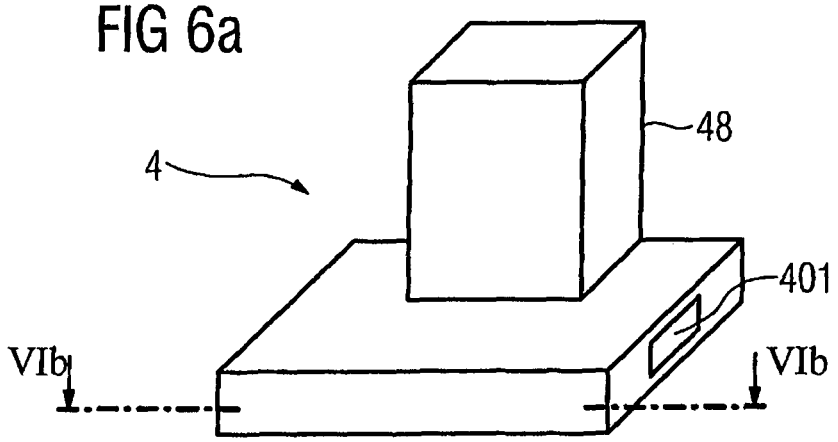
Figure 6B:
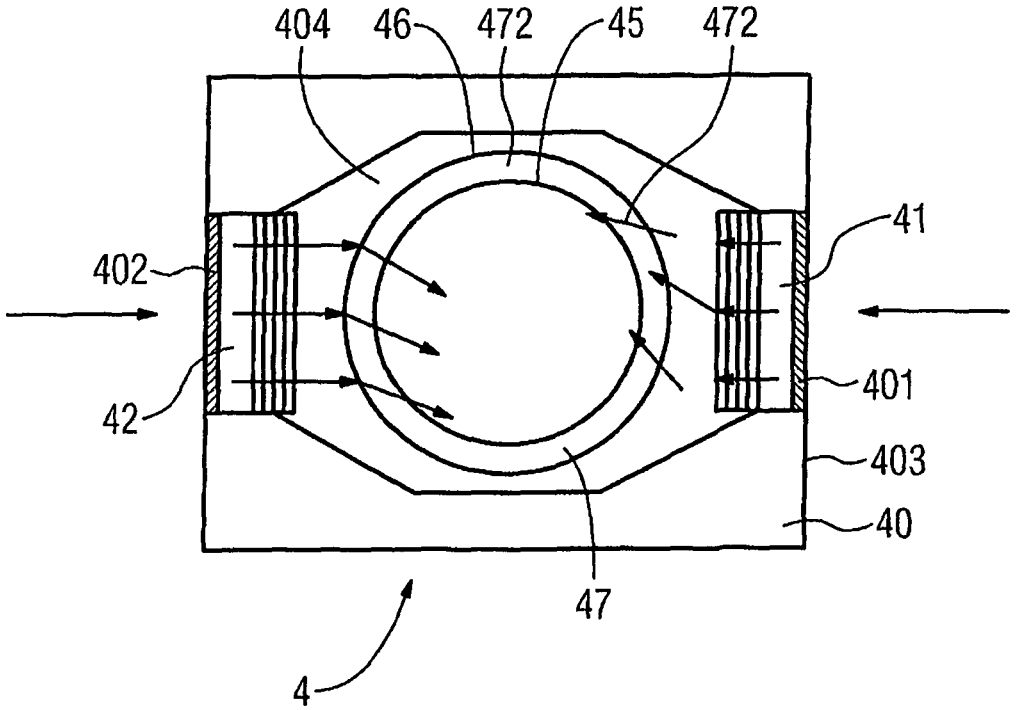
Figure 6C:
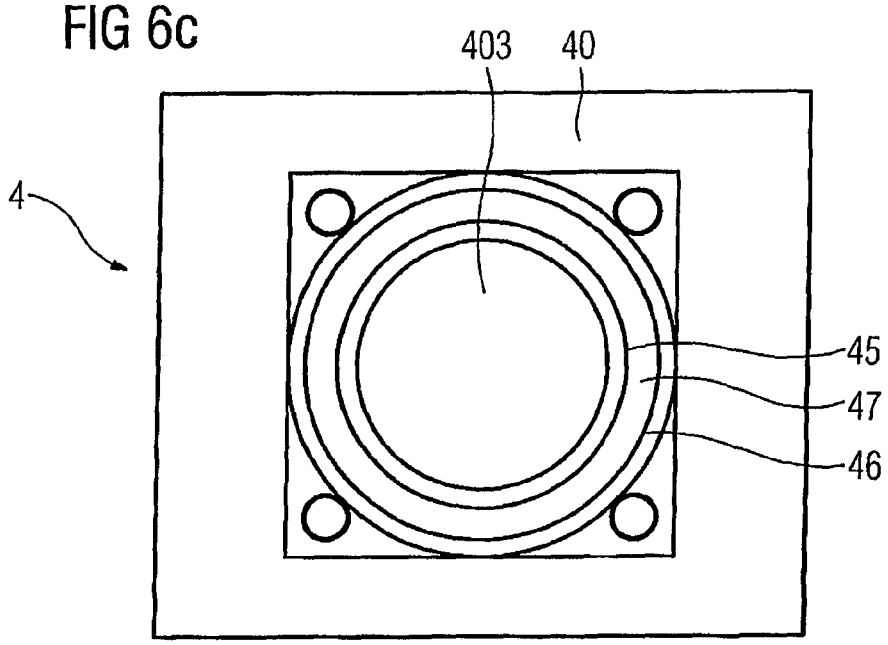
Figure 6D:
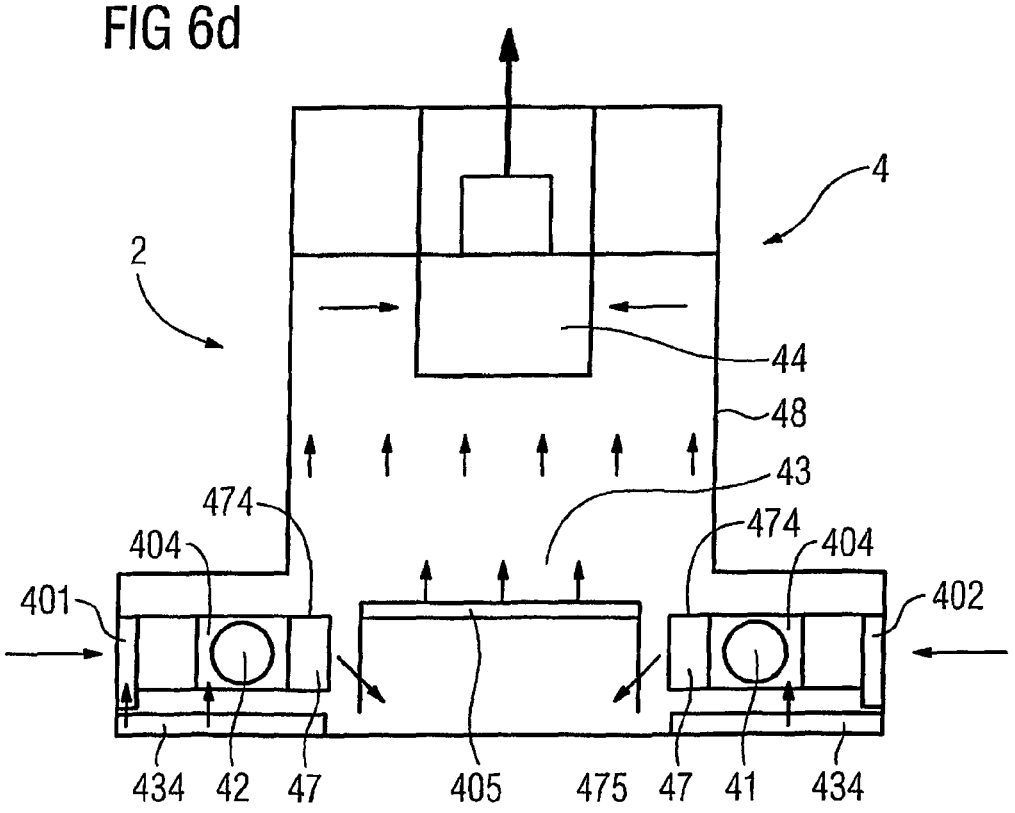
Figure 7A:
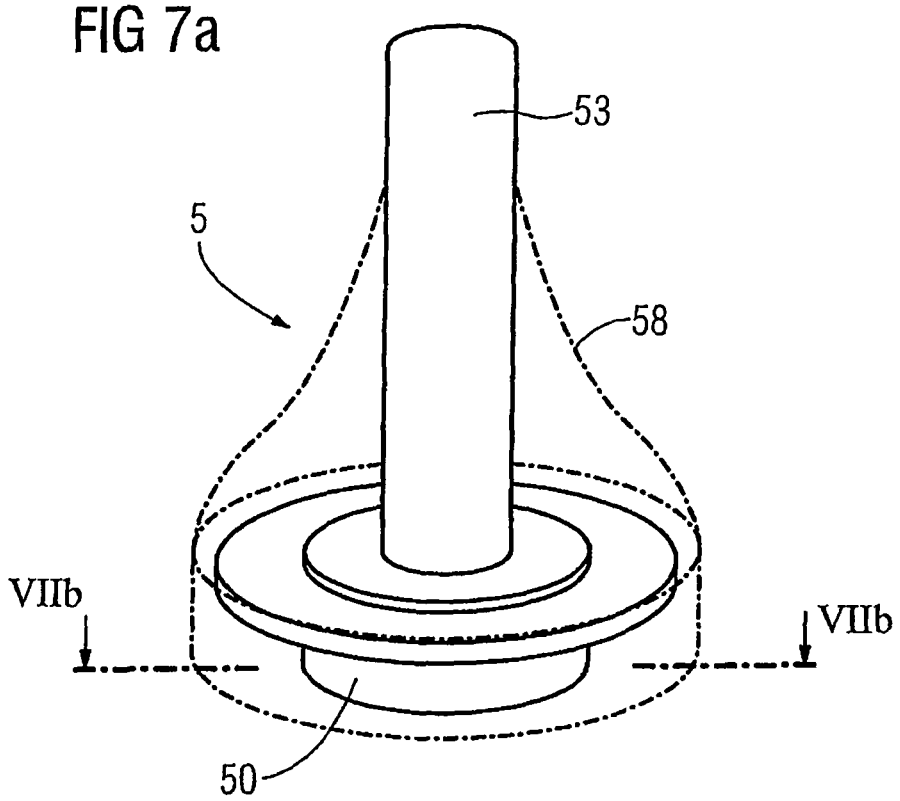
Figure 7B:
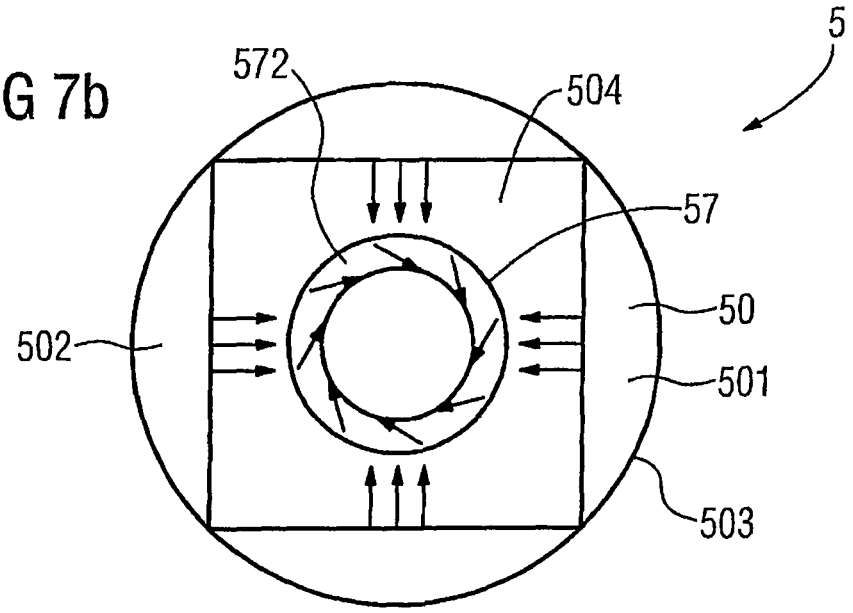
Figure 7C:
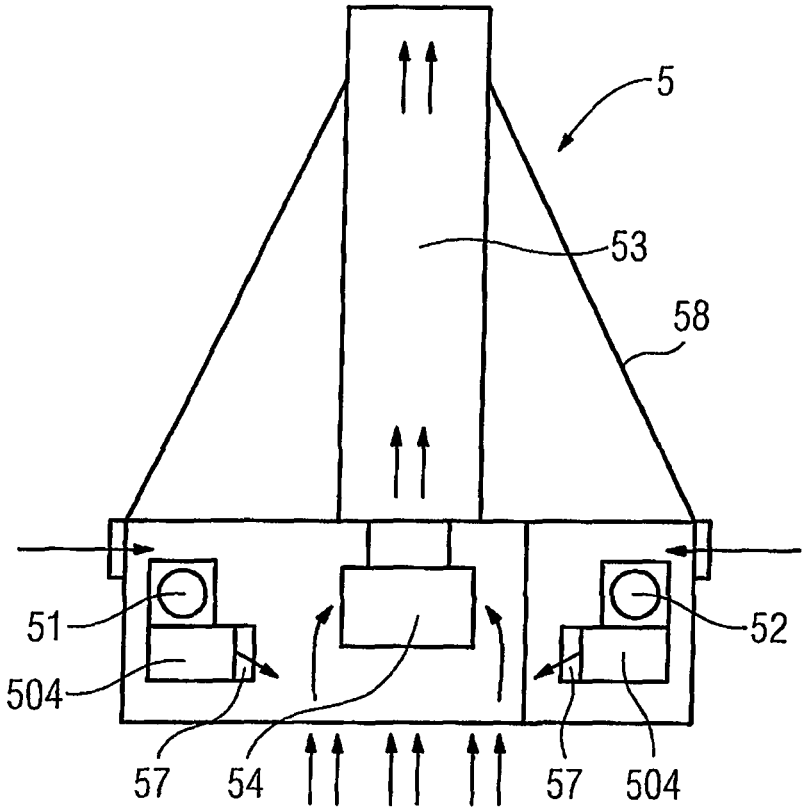

The invention will now be described in further details with references to the schematical drawings in which FIG. 1*c* outlines the concept of a tornado suction hood, FIG. 2*d* shows the pressure field of a hood system according to FIG. 1*c*, FIG. 2 shows a suction hood according to the invention, FIG. 3*a* shows a ring shaped area which comprises a part of the vortex generator according to the invention in a plan view, FIG. 3*b* shows a ring shaped area in a diffuser box, which contains the vortex generator, FIGS. 4*a* to 4*d* show a suction hood according to the invention, FIGS. 5*a* to 5*d* show a similar arrangement of a suction hood according to the invention, FIGS. 6*a* to 6*d* show another embodiment of a suction hood according to the invention and in which FIGS. 7*a* to 7*c* show an embodiment with a suction hood similar to the embodiment according the FIGS. 6*a* to 6*d*.

FIG. 1*c* outlines the concept of a tornado suction hood 1. The arrows 75 represent the rotating column of air and the arrows 74 represent the suction draft. The combination of these two flows generates the tornado. The air is sucked in through air inlets 101, 102 and therefore pushed into the suction channel 13.

Figure 1D:
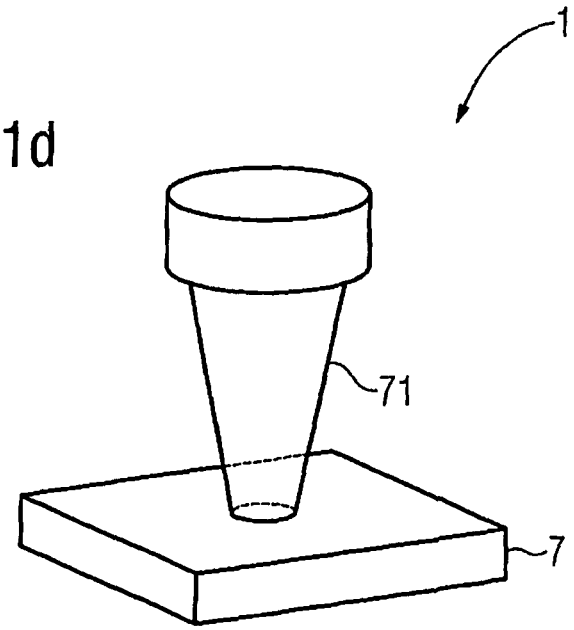

The pressure field 71 of such a hood system 1 is shown in FIG. 1*d*. The pressure field represents the effective suction volume of the hood. The generated vortex between the cooktop 7 and the hood 1 sucks in the fume from the cooktop 7 in a swirling motion.

FIG. 2 shows a suction hood 1 according to the invention, which is arranged in a housing 18. At the lower end of the housing 18, a vortex generator 10 is arranged, from which a suction channel 131, 130 extends to an opening at the top. In the lower part 131, the suction channel is upwardly narrowing cone-shaped, whereas in the upper part 130, the suction channel proceeds with a constant diameter.

The vortex generator 10 is arranged in a box 103, where on the sides, cross sections through the ring shaped area 17 with cross to sections through its upper cover 174 and its lower cover 175 can be seen. On top of the vortex generator 10, a filter 105 is arranged.

The suction means, vortex generator or tornado suction means 10 can be installed in different type of hoods and is able to create a rotating column of air to improve the suction draft.

FIG. 3*a* shows, in a plan view, the ring shaped area 17 between an inner circle 15 and an outer circle 16 as inner or central part of the vortex generator 10 according to the invention.

The ring shaped area 17 inside the vortex generator comprises a number of blades 171, which are arranged at least substantially tangentially with respect to the inner circle 15 and distributed uniformly around the ring shaped area 17.

Between each of two neighboured blades 171, a tangential channel 172 is formed, so that the neighboured tangential channels 172 are separated by the blades 171. The blades are arranged between the inner circle 15 and the outer circle 16. An arrow shows the main streaming direction of the air which is used for generating the vortex.

FIG. 3*b* shows the vortex generator 10 in a perspective view. Around the center, the ring shaped area 17 can be seen, which generates the vortex. Again, blades 171 can be seen between the upper cover 174 and the lower cover 175, wherein between the blades 171 channels 172 are formed for guiding the air. The vortex generator 10 is housed in the box 103 with square-shaped cross section.

Figure 4A:
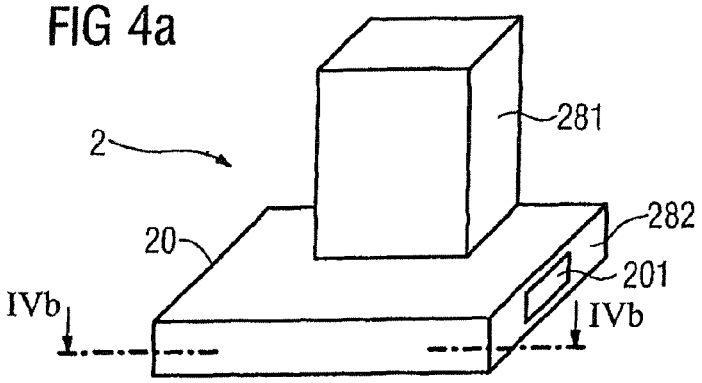
Figure 4B:
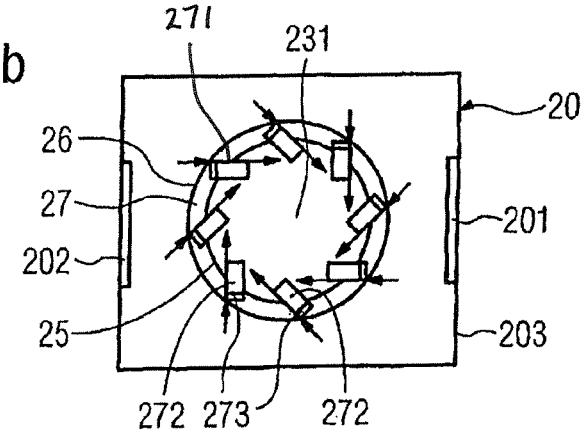
Figure 4C:
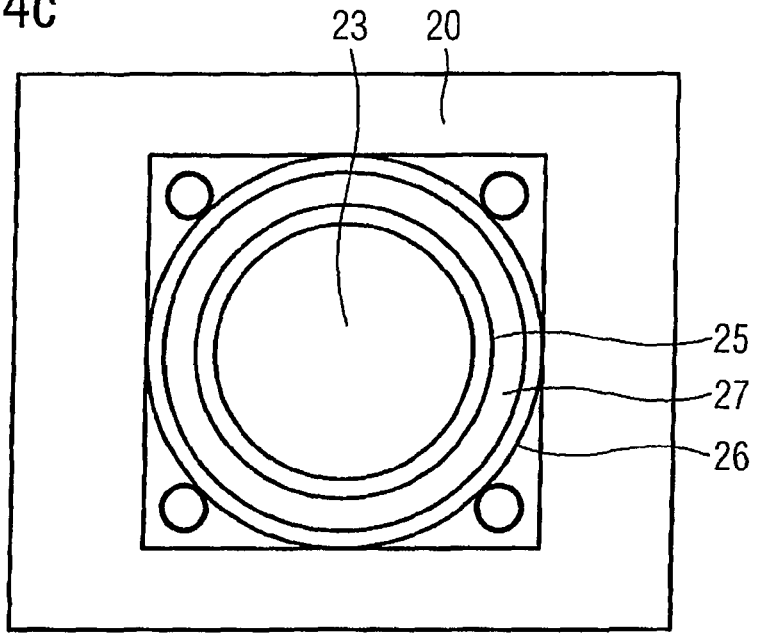
Figure 4D:
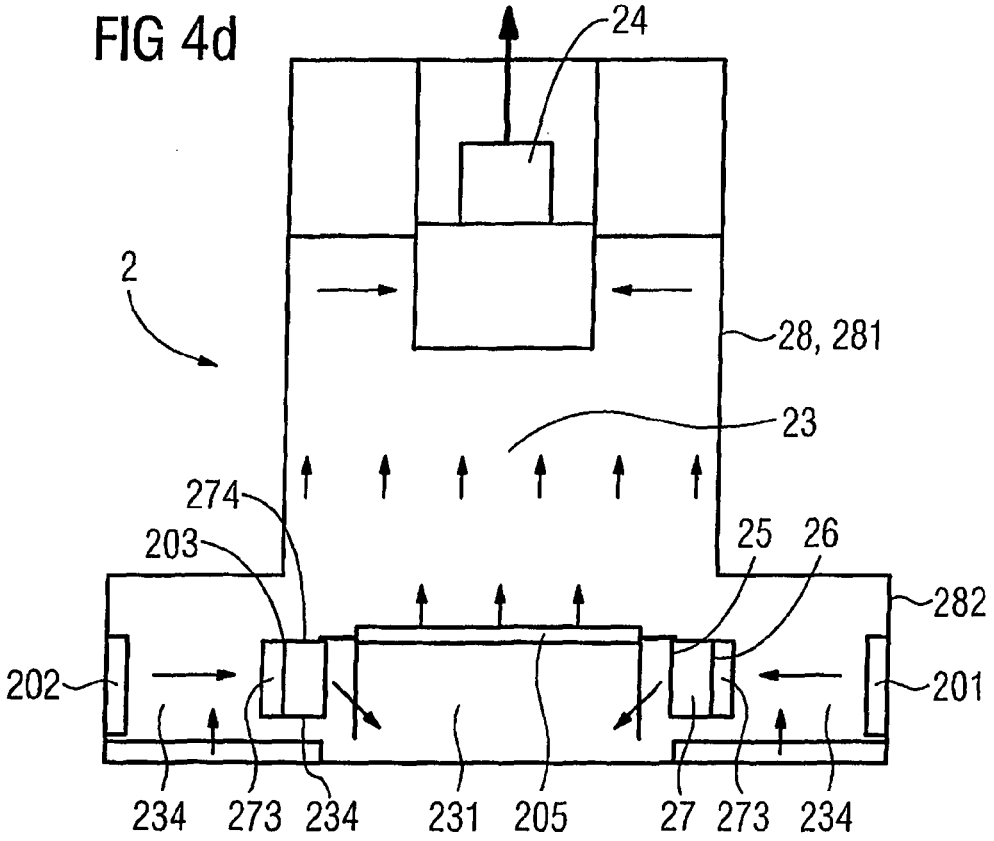

FIG. 4*a* to FIG. 4*d* show a suction hood 2 with a vortex module 20 in a box 203 with square-shaped cross section, wherein FIG. 4*a* shows a perspective view, FIG. 4*b* shows a horizontal cross sectional view through the vortex module 20, FIG. 4*c* shows a bottom view of the hood and FIG. 4*d* shows a cross sectional view from the top to the bottom of the hood.

The suction hood 2 comprises a cuboidal upper box section 281 under which a lower box section 282 with an at least nearly square shaped upper and lower surface, between which four longish side surfaces are arranged. At the sides of the lower box section 282, air inlets 201 and 202 are arranged, which guide air to the suction area 234.

The upper box section 281 and the lower box section 282 are arranged directly adjacent, connected with each other and preferably form a single part, so that the cross section of the upper section 281 is, at its lower end, expanded by the lower section 282, wherein the internal transition area between the upper section 281 and the lower section 282 is entirely open to allow the air to flow through.

The hood 2 comprises, what can be seen in FIG. 4*d*, a second sucking means 24 inside the upper box section 281 which pulls the air to the suction hood by generating an at least substantially direct suction to the suction hood 2 and a sucking means 20 inside the lower box section 282 which pulls the air to the suction hood 2 by generating an at least substantially circular, cyclone or helix movement.

The vortex generator 20 is arranged over the central suction inlet and comprises a ring shaped area 27 which is arranged between an inner circle 25 and an outer circle 26. The ring shaped area 27 inside the vortex generator comprises a number of blades 271, which can be seen in FIG. 4*b* and which are arranged at least substantially tangentially with respect to the inner circle 25 and distributed uniformly around the ring shaped area 27.

Between two neighboured blades 271, a tangential channel 272 is formed, so that the neighboured tangential channels 272 are laterally limited by the blades 271. The blades are, at least substantially, arranged between the inner circle 25 and the outer circle 26.

To drive the air, a fan 273 is arranged in the outer end of each or at least some of the channels. The engines of the fans blow the air at least substantially tangentially into the suction area 231 of the hood 2 and thus generate the circulating air. Arrows in FIG. 4*b* show the main streaming direction of the air which is used for generating the vortex. At the sides, air inlets 201 and 202 are shown. On top of the vortex generator 20, a filter 205 is arranged.

FIG. 4*d* shows the air rising to the outlet 24.

FIGS. 5*a* to 5*d* show a similar arrangement of a suction hood according to the invention like FIGS. 4*a* to 4*d*. However, in this case, the vortex module 30 as well as the box 38 have a round, circular cross section.

FIG. 5*a* shows a perspective view, FIG. 5*b* shows a horizontal cross sectional view through the vortex module 30, FIG. 5*c* shows a bottom view of the hood and FIG. 5*d* shows a cross sectional view from the top to the bottom of the hood.

The suction hood 3 comprises a cylindrical upper box section 381 under which a cylindrical lower box section 382 is arranged. At the sides of the lower box section 381, air inlets 301 and 302 are arranged.

The upper box section 381 is widening to the lower box section 382. Both sections are connected with each other and preferably form a single part, so that the cross section of the upper section 381 is, at its lower end, expanded by the lower section 382, wherein the internal transition area between the upper section 381 and the lower section 382 is entirely open to allow the air to flow through.

The hood 3 comprises a sucking means 30 inside the lower box section 382 which pulls the air to the suction hood 3 by generating an at least substantially circular, cyclone or helix movement.

The vortex generator 30 is arranged over the central suction inlet and comprises a ring shaped area 37 which is arranged between an inner circle 35 and an outer circle 36. The ring shaped area 37 between an upper cover 374 and a lower cover 375 inside the vortex generator comprises a number of blades 371, which can be seen in FIG. 5*b* and which are arranged at least substantially tangentially with respect to the inner circle 35 and distributed uniformly around the ring shaped area 37.

Between two neighboured blades 371, a tangential channel 372 is formed, so that the neighboured tangential channels 372 are laterally limited by the blades 371. The blades are, at least substantially, arranged between the inner circle 35 and the outer circle 36.

To drive the air, a fan 373 is arranged in the outer end of each or at least some of the channels. The engines of the fans blow the air at least substantially tangentially into the suction area 33 of the hood 3 and thus generate the circulating air. Arrows show the main streaming direction of the air which is used for generating the vortex. At the sides, air inlets 301 and 302 are shown. On top of the vortex generator 30, a filter 305 is arranged.

FIG. 5*d* shows the air rising to the outlet 332. Furthermore, a suction means 34 is arranged in the center of the lower box section.

FIGS. 6*a* to 6*d* show a further embodiment of a suction hood 4 in a box 48 according to the invention with a vortex module 40. FIG. 6*c* shows a view of the suction hood 4 from the bottom and FIG. 6*d* shows a sectional view of the suction hood 4.

In this embodiment, the vortex is generated by two engines 41 and 42, which are arranged at both sides of the suction hood 4 inside openings 401 and 402. As an alternative, the motors can also be mounted on the side, on the top or underneath the vortex generator 40.

The air sucked in by the motors 41 and 42 through lateral openings 401 and 402 as well as bottom openings 434 is guided to the blades 472, which are inside the ring 47 between an upper cover 474 and a lower cover 475.

Between the channels 472 and the fans 41 and 42, a distribution chamber 404 is arranged.

The distribution chamber 404 is surrounding the channels 472 in radial direction. Beyond the distribution chamber 404, the fans 41 and 42 for supplying the distribution chamber 404 with air are arranged.

The distribution chamber 404 supplies the channels 472 with air for generating the at least substantially circular, cyclone, vortex or helix movement.

In the upper part, a suction means 44 is arranged.

FIGS. 7*a* to 7*c* show an embodiment with a suction hood 5 similar to the embodiment according the FIGS. 6*a* to 6*d*. FIGS. 7*b* and 7*c* show different cross sectional views.

In this embodiment, the suction hood 5 has a round cross section in a box 58. FIG. 7*d* shows two engines 51 and 52, which push air into the round shaped area 57 via the distribution chamber 504. The generated vortex then generates a suction 53. Furthermore, a suction means 54 is arranged near the round shaped area 57.

LIST OF REFERENCE SIGNS

1, 1', 2, 3, 4, 5, 6 suction hood
10, 20, 30, 40 vortex generator (diffusor box)
103, 203, 303, 403, 503 box (vertex)
404, 504 distribution chamber
105, 205, 305, 405 filter
17, 27, 37, 47, 57 ring shaped area
171 blades
172, 272, 372, 472 tangential channels
174, 274, 374, 474 upper cover
175, 275, 375, 475 lower cover
15, 25, 35, 45 inner circle
16, 26, 36, 46 outer circle
18, 28, 38, 48, 58 housings (hood)
13, 23, 33, 43, 53, 130, 131 suction channels
273, 373, 41, 42, 51, 52 motor
24, 34, 44, 54 suction means
101, 102, 201, 202, 401, 402 air inlets
61 first sucking means
62 second sucking means
7, 7' cooktops
71, 71' pressure fields
74, 75, 74' air movement

The invention claimed is:

1. A sucking means for a suction hood comprising at least one of a vortex generator and a tornado suction means, which pulls air into the suction hood by generating an at least substantially circular, cyclone, vortex or helix movement, wherein the sucking means comprises a ring shaped area with at least one of substantially tangential channels and channels with a tangential component which are separated from each other by separating elements comprising blades, for generating the at least substantially circular, cyclone, vortex or helix movement, wherein the ring shaped area circumscribes a suction area within the suction hood through which the air that is pulled into the suction hood enters, wherein the suction area is above a lower end of the ring shaped area, and wherein the sucking means further comprises, in at least one of the channels, a fan configured to direct air inward through the ring shaped area and directly into the suction area for generating the at least substantially circular, cyclone, vortex or helix movement.

2. The sucking means according to claim 1, wherein each channel is, on one side, delimited by an upper cover and on one side delimited by a lower cover of the sucking means and wherein each channel is on two sides delimited by the separating elements which are in between them.

3. The sucking means according to claim 1, wherein the sucking means comprises at least one fan, wherein between the channels and the at least one fan, a distribution chamber is arranged.

4. The sucking means according to claim 1, wherein a distribution chamber is surrounding the channels in a radial direction, wherein, radially, beyond the distribution chamber, at least one fan for supplying the distribution chamber with air is arranged, where the distribution chamber supplies the channels with air for generating the at least substantially circular, cyclone, vortex or helix movement.

5. The sucking means according to claim 1, wherein the sucking means is arranged in a box which can be at least one of inserted into and taken out of the hood.

6. The sucking means according to claim 1, wherein the sucking means comprises a filter mounted on an upper cover of the sucking means.

7. The sucking means according to claim 1, wherein the ring-shaped area defines an inner ring and an outer ring, the inner ring being arranged inside the outer ring.

8. The sucking means according to claim 7, wherein the inner ring further defines a suction area of the sucking means through which the air is pulled.

9. The sucking means according to claim 7, wherein each channel is, on one side, delimited by an upper cover and on one side delimited by a lower cover of the sucking means and wherein each channel is on two sides delimited by the separating elements which are in between them, wherein at least one of the upper cover and the lower cover extends between the inner ring and the outer ring.

10. The sucking means according to claim 7, wherein the fan in the least one of the channels directs air from the outer ring inward toward the inner ring for generating the at least substantially circular, cyclone, vortex or helix movement.

11. The sucking means according to claim 7, wherein outer ends of the blades are arranged around the outer ring and wherein inner ends of the blades are arranged around the inner ring.

12. The sucking means according to claim 11, wherein the fan in the at least one of the channels directs air in a direction from the outer ends of the blades toward the inner ends of the blades for generating the at least substantially circular, cyclone, vortex or helix movement.

13. The sucking means according to claim 11, wherein each channel is, on one side, delimited by an upper cover and on one side delimited by a lower cover of the sucking means and wherein each channel is on two sides delimited by the separating elements which are in between them, wherein at least one of the upper cover and the lower cover extends between the outer ends of the blades and the inner ends of the blades.

14. The suction hood comprising the sucking means according to claim 1, wherein an outer suction area around the suction means surrounds an inner suction area inside the ring shaped area wherein the sucking means sucks the air to the suction hood through the inner suction area.

15. The suction hood comprising the sucking means according to claim 1, wherein the air for operating the sucking means is sucked in laterally through at least one of lateral openings and from an outer suction area.

16. The suction hood comprising the sucking means according to claim 1, wherein a second sucking means comprising an additional fan is arranged for pushing air out of the hood wherein the second sucking means sucks air to the suction hood uniformly through an inner and an outer suction area.

17. The suction hood comprising the sucking means according to claim 1, wherein the sucking means boosts or can boost a second suction means where the boosting is dependent on at least one of noise, efficiency and fumes, and wherein the means used for boosting is at least one of a switch and a sensor driven device.

18. The suction hood comprising the sucking means according to claim 1, wherein the sucking means is arranged at or near at least one of a lower surface of the hood and a broadened area of the hood.

19. The suction hood comprising the sucking means according to claim 1, wherein the suction hood is at least one of a vented suction hood and a recirculating suction hood.

20. The suction hood comprising the sucking means according to claim 1, wherein a second sucking means comprising a standard suction means is arranged at or near at least one of a lower surface of the hood and a narrowed area of the hood.

21. A sucking means for a suction hood comprising at least one of a vortex generator and a tornado suction means, which pulls air into the suction hood by generating an at least substantially circular, cyclone, vortex or helix movement, wherein the sucking means comprises a ring shaped area with at least one of substantially tangential channels and channels with a tangential component which are separated from each other by separating elements comprising blades, for generating the at least substantially circular, cyclone, vortex or helix movement, and wherein the sucking means further comprises, in at least one of the channels, a fan for generating the at least substantially circular, cyclone, vortex or helix movement, wherein the fan is configured to direct air inward through the ring shaped area in a horizontal direction that is perpendicular to an upward exhaust airflow of the suction hood.

22. A sucking means for a suction hood comprising at least one of a vortex generator and a tornado suction means, which pulls air into the suction hood by generating an at least substantially circular, cyclone, vortex or helix movement, wherein the sucking means comprises a ring shaped area with at least one of substantially tangential channels and channels with a tangential component which are separated from each other by separating elements comprising blades, for generating the at least substantially circular, cyclone, vortex or helix movement, wherein the sucking means further comprises, in at least one of the channels, a fan configured to direct air inward through the ring shaped area for generating the at least substantially circular, cyclone, vortex or helix movement, and wherein the blades each comprise a plate that extends between an annular upper cover member and an annular lower cover member.

23. The sucking means according to claim 22, wherein each blade forms a wall of two adjacent channels.

* * * * *